US007162049B2

(12) United States Patent
Polk, Jr.

(10) Patent No.: US 7,162,049 B2
(45) Date of Patent: Jan. 9, 2007

(54) PORTED LOUDSPEAKER SYSTEM AND METHOD WITH REDUCED AIR TURBULENCE, BIPOLAR RADIATION PATTERN AND NOVEL APPEARANCE

(75) Inventor: Matthew S Polk, Jr., Gibson Island, MD (US)

(73) Assignee: Britannia Investment Corporation, San Diego, CA (US)

( * ) Notice: Subject to any disclaimer, the term of this patent is extended or adjusted under 35 U.S.C. 154(b) by 40 days.

(21) Appl. No.: 10/337,347

(22) Filed: Jan. 7, 2003

(65) Prior Publication Data

US 2004/0131219 A1 Jul. 8, 2004

(51) Int. Cl.
*H04R 1/28* (2006.01)

(52) U.S. Cl. ..... 381/345; 181/156

(58) Field of Classification Search ..... 381/335, 381/186, 337, 338, 342, 345, 351, 163, 357, 381/180, 349, 350, 389, 71.4, 71.7, 146; 181/163, 147, 156, 145, 160, 199, 144, 155
See application file for complete search history.

(56) References Cited

U.S. PATENT DOCUMENTS 3,688,864 A * 9/1972 Guss ..... 381/89
4,284,166 A * 8/1981 Gale ..... 181/156
5,092,424 A * 3/1992 Schreiber et al. ..... 181/145
5,517,573 A * 5/1996 Polk et al. ..... 381/345
5,714,721 A * 2/1998 Gawronski et al. ..... 181/156
5,721,401 A * 2/1998 Sim ..... 181/148
5,809,154 A * 9/1998 Polk ..... 381/345
5,825,900 A * 10/1998 Jeon ..... 381/339
6,321,070 B1 * 11/2001 Clark et al. ..... 455/575.1
6,389,146 B1 * 5/2002 Croft, III ..... 381/345
6,634,455 B1 * 10/2003 Yang ..... 181/156
2002/0061114 A1 * 5/2002 Croft, III ..... 381/345

* cited by examiner

*Primary Examiner*—Sinh Tran
*Assistant Examiner*—Walter F Briney, III
(74) *Attorney, Agent, or Firm*—Sterne, Kessler, Goldstein & Fox, P.L.L.C.

(57) ABSTRACT

A loudspeaker system includes a cabinet with an interior air volume, a transducer, a first port extending from an opening in the front wall of the cabinet to the interior of the cabinet, and a second port extending from and opening in the rear wall of the cabinet to the interior of the cabinet. The first and second ports are aligned along a common longitudinal axis and the interior ends of the ports are separated from each other by a predetermined distance. First and second flanges having a diameter larger than the first and second ports are disposed at the interior ends of the first and second ports, respectively.

31 Claims, 6 Drawing Sheets

Fig. 1 - Prior Art

Fig. 2, Prior Art

Fig. 3, Prior Art

PORTED LOUDSPEAKER SYSTEM AND METHOD WITH REDUCED AIR TURBULENCE, BIPOLAR RADIATION PATTERN AND NOVEL APPEARANCE

CROSS-REFERENCE TO RELATED APPLICATIONS

Not Applicable

BACKGROUND OF THE INVENTION

1. Field of the Invention

This invention relates generally to loudspeaker systems and in particular relates to an improved loudspeaker having a unique port or vent geometry together with a corresponding method of porting a loudspeaker in an efficient manner and with a novel appearance.

2. Related Art

Vented box loudspeaker systems have been popular for at least 50 years as a means of obtaining greater low frequency efficiency from a given cabinet volume. Significant advances were made in understanding and analyzing vented loudspeaker systems through the work of Thiele and Small during the 1970's. Since then, readily available computer programs have made it possible to easily optimize vented loudspeaker designs. However, practical considerations often prevent these designs, optimized in theory, from being realized in actuality or from functioning as intended.

There are two basic approaches in common use in connection with vented loudspeaker systems, these being the ducted port and the passive radiator. Although the passive radiator approach has some advantages, the ducted port has been, in general, more popular due to lower cost, ease of implementation and generally requiring less space.

There are, however, disadvantages to the ducted port approach. These relate principally to undesirable noise and attendant losses which may be generated by the port at the higher volume velocity of air movement required to produce higher low frequency sound pressure levels. For example, as is well known to those skilled in the art, a vented loudspeaker system has a specific tuning frequency, fp, determined by the volume of air in the enclosure and the acoustic mass of air provided by the port according to the relationship;

$$fp := \frac{1}{2 \cdot \pi \sqrt{MAP \cdot CAB}} \cdot \mathrm{Hz}$$

where MAP is the acoustic mass of the port and CAB is the compliance of the air in the enclosure. In general, a lower tuning frequency is desirable for higher performance loudspeaker systems. As can be seen, either greater acoustic mass in the port or greater compliance resulting from a larger enclosure volume is required to achieve a lower tuning frequency. The acoustic mass of a port is directly related to the mass of air contained within the port but inversely related to the cross-sectional area of the port. This suggests that to achieve a lower tuning frequency a longer port with smaller cross-sectional area should be used. However a small cross-section is in conflict with the larger volume velocities of air required to reproduce higher sound pressure levels at lower frequencies. For example, if the diameter of a port is too small or is otherwise improperly designed, non-linear behavior such as chuffing or port-noise due to air turbulence can result in audible distortions and loss of efficiency at low frequencies particularly at higher levels of operation. In addition, viscous drag from air movement in the port can result in additional loss of efficiency at lower frequencies. Increasing the cross-sectional area of a port can reduce turbulence and loss but the length of the port must be increased proportionally to maintain the proper acoustic mass for a given tuning frequency. The required increase in length, however, may be impractical to implement. Other difficulties may also arise as the length of the port and cross-section are increased. Organ pipe resonances occur in open-ended ducts at a frequency which is inversely proportional to the length of the duct. These organ pipe resonances may produce easily audible distortion when they occur within certain ranges of frequencies. For example a duct nine inches in length will have a highly audible principle resonance at approximately 700 Hz while a duct only 3 inches in length would have a much less audible principle resonance at approximately 2,100 Hz. In fact, a typical strategy employed in the design of vented loudspeaker systems is the use of shorter ports such that the organ pipe resonances occur at higher frequencies where they are less audible and less likely to be within the range of the transducers mounted in the enclosure. In addition, a larger cross-sectional area may lead to undesirable transmission of mid-range frequencies generated inside the enclosure to the outside of the enclosure. This may also lead to audible distortion in the form of frequency response variations due to interference with the direct sound produced by the loudspeaker system.

Therefore, the design of ports for vented loudspeaker systems involves conflicting requirements. A large cross-sectional area is required to avoid audible noise and losses due to non-linear turbulent flow but this makes it difficult to achieve the acoustic mass required for a low tuning frequency within practical size constraints. As will be familiar to those skilled in the art, various methods have been employed to construct ports with reduced turbulence and loss. One such example is shown in FIG. 1, which is a cross-sectional view of a loudspeaker enclosure 100 including a transducer 102 and a port 104 that is flared at one or both ends of the port in order to reduce turbulence. The flared port 104 operates to reduce turbulence by increasing the cross-sectional area of the port at one or both ends thereby slowing the particle velocity of air at the exits. This allows for a smaller cross-section in the middle section of the port and a higher acoustic mass for a given length. However, in order to be effective, the required flared ends 106, 108 may be quite large and may, themselves, add significantly to the overall port length without significantly contributing to the acoustic mass. The increased cross-section of the flare may increase the transmission of undesirable midrange frequencies from inside the loudspeaker cabinet and an improperly selected rate of flare may actually increase turbulence.

Another conventional method used to decrease turbulence and loss is shown in FIG. 2, which is a cross-sectional view of a loudspeaker enclosure 200 with a transducer 102 and multiple ports 204 and 206. Using multiple ports 204 and 206 decreases turbulence and loss by taking advantage of the combined cross-sectional area of several ports. However, as with a single port, the length of each of the multiple ports must be increased to account for the greater total cross-section. For example, if two identical ports are used they will both need to be approximately twice as long as a single port of the same cross-section to achieve the same acoustic mass and tuning frequency. As discussed above this may lead to impractical length requirements and more audible organ pipe resonances.

Other techniques are also used to reduce turbulence and loss as well as the other difficulties associated with the design of ports as previously discussed. These include ports with rounded or flanged ends, geometries to reduce organ pipe resonances and a plethora of methods for implementing longer ports through folding or other convolutions.

U.S. Pat. Nos. 5,517,573 and 5,809,154 to Polk, et al., incorporated herein in their entirety by reference, disclose improved porting methods for achieving the required acoustic mass in a compact space with reduced turbulence and loss. FIG. 3 is a reproduction of FIG. 7 from the '573 patent. The method described in these patents involves the use of a disk at the end or ends of a simple duct to effectively create an increasing cross-sectional area at the ends of the port. In some preferred embodiments flow guides are also used to further improve the efficiency of the port structure. This method has the advantages of suppressing transmission of midrange frequencies from inside the cabinet and of providing the required acoustic mass in a more compact form which also reduces turbulence and loss.

SUMMARY OF THE INVENTION

It is an object of this invention to provide an improved porting arrangement and method for use in a loudspeaker system with reduced turbulence and loss, reduced transmission of midrange frequencies and less audible organ pipe resonances.

It is another object of this invention to provide an efficient port structure with a novel appearance which is more compact, simpler to implement and which has a bipolar radiation pattern.

Briefly and in accordance with one embodiment of the present invention, a first port is provided in the speaker baffle of the loudspeaker system with a predetermined length extending inwardly into the speaker cabinet. A second port is provided in the opposite wall of the loudspeaker enclosure from the speaker baffle of similar cross-section to the first port with a predetermined length extending inwardly into the speaker cabinet toward the first port and aligned on a common axis with the first port such that the inward ends are separated by a predetermined separation distance inside the loudspeaker enclosure and such that the two ports together appear to provide an unobstructed open duct passing entirely through the loudspeaker cabinet from front to back. The additional acoustic mass required to achieve a desired tuning frequency is provided by flanges of a predetermined diameter, greater than the ports, affixed concentrically to the inward end of each of the ports and separated by a predetermined separation distance. The two flanges or disks provide a circumferential extension of the internal separation distance between the two ports. The effect of this arrangement is to provide an increasing cross-sectional area at the inside end of the port structure for the purpose of reducing turbulence and loss. Mid-range transmission from the interior of the loudspeaker cabinet is suppressed since higher frequencies will tend to pass through the separation between the two ports with very little midrange energy escaping through the ports to the exterior of the loudspeaker cabinet. The principle organ pipe resonance due to the combined length of the ports is also suppressed due to the separation distance between the two ports. Due to the front and back openings, the port structure of the present invention will also have a radiation pattern which is approximately bipolar at low frequencies. Bipolar radiation of sound refers to the radiation of in-phase acoustic energy from both front and back of a loudspeaker system in similar but not necessarily equal amounts. Bipolar radiation of sound is believed to result in a more even distribution of low frequency energy into the listening area. In addition, the two port openings provide a larger cross-sectional area which further reduces turbulence and loss. Finally, the illusion of an unobstructed duct passing entirely through the loudspeaker enclosure presents a novel appearance.

BRIEF DESCRIPTION OF THE DRAWINGS/FIGURES

Figure 3:
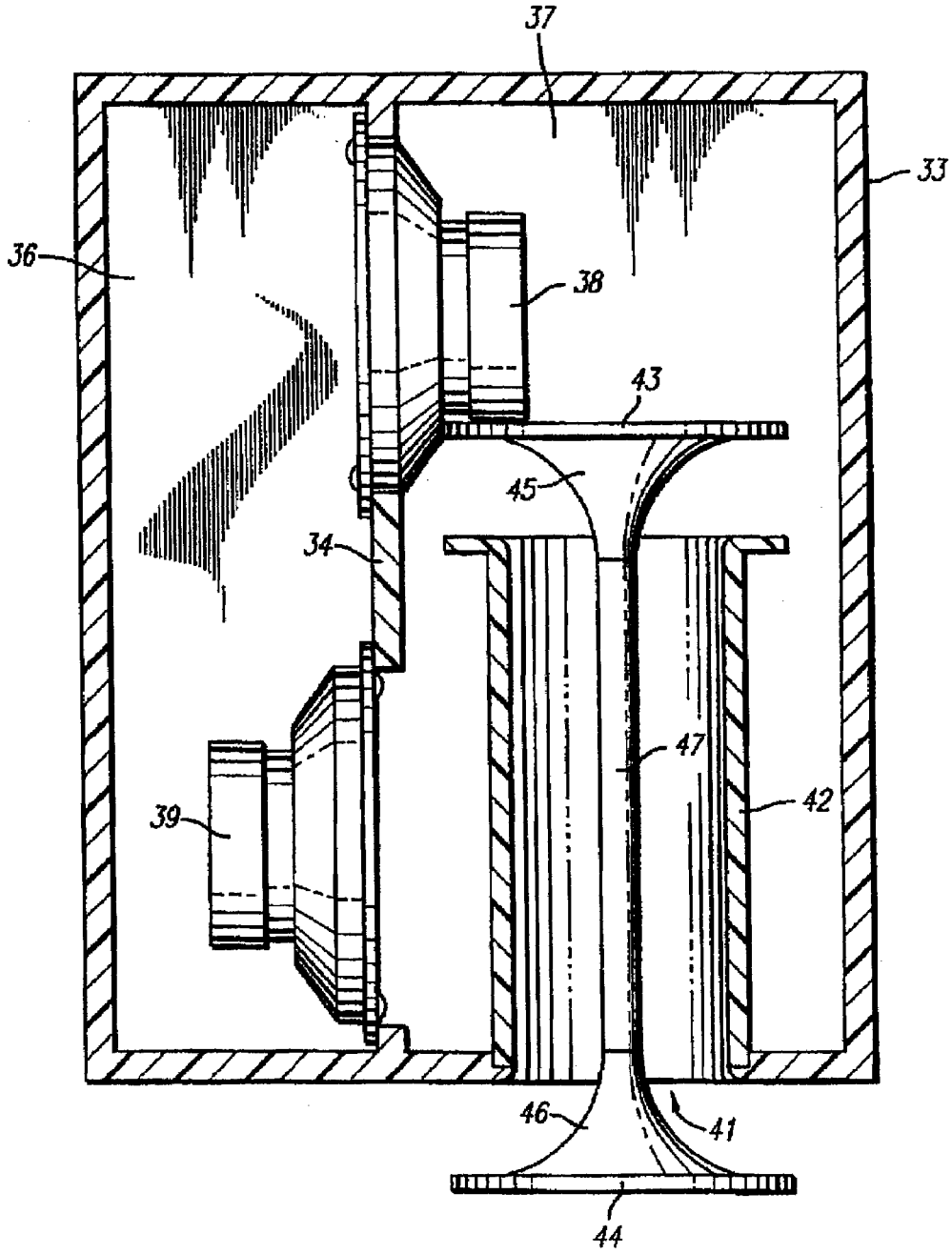

FIG. 3 is a cross-sectional view of a vented loudspeaker woofer having a port geometry in accordance with the principles of U.S. Pat. No. 5,517,573.

Figure 4:
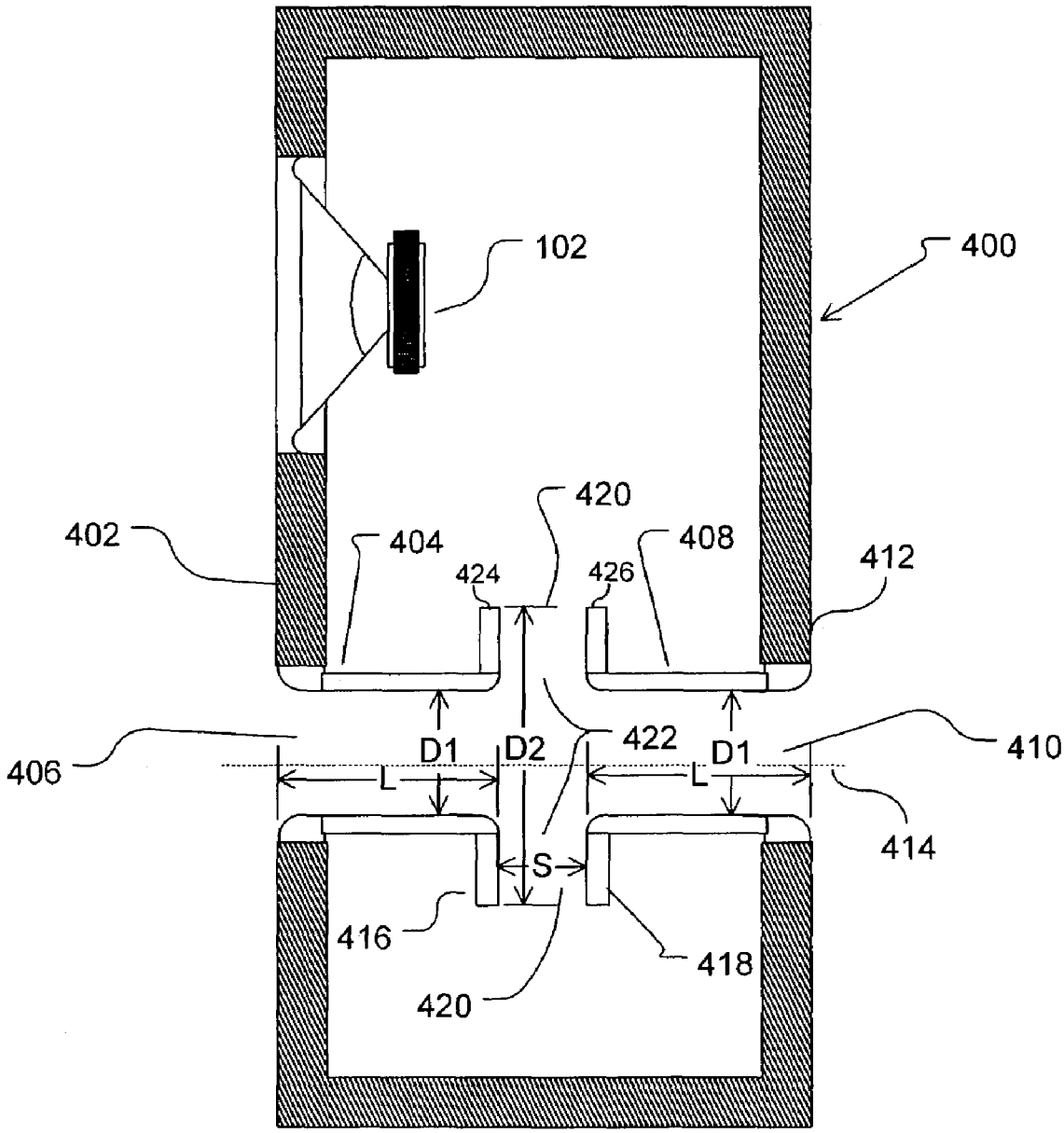

FIG. 4 is cross-sectional view of vented loudspeaker having a port geometry in accordance with the principles of the present invention.

Figure 5:
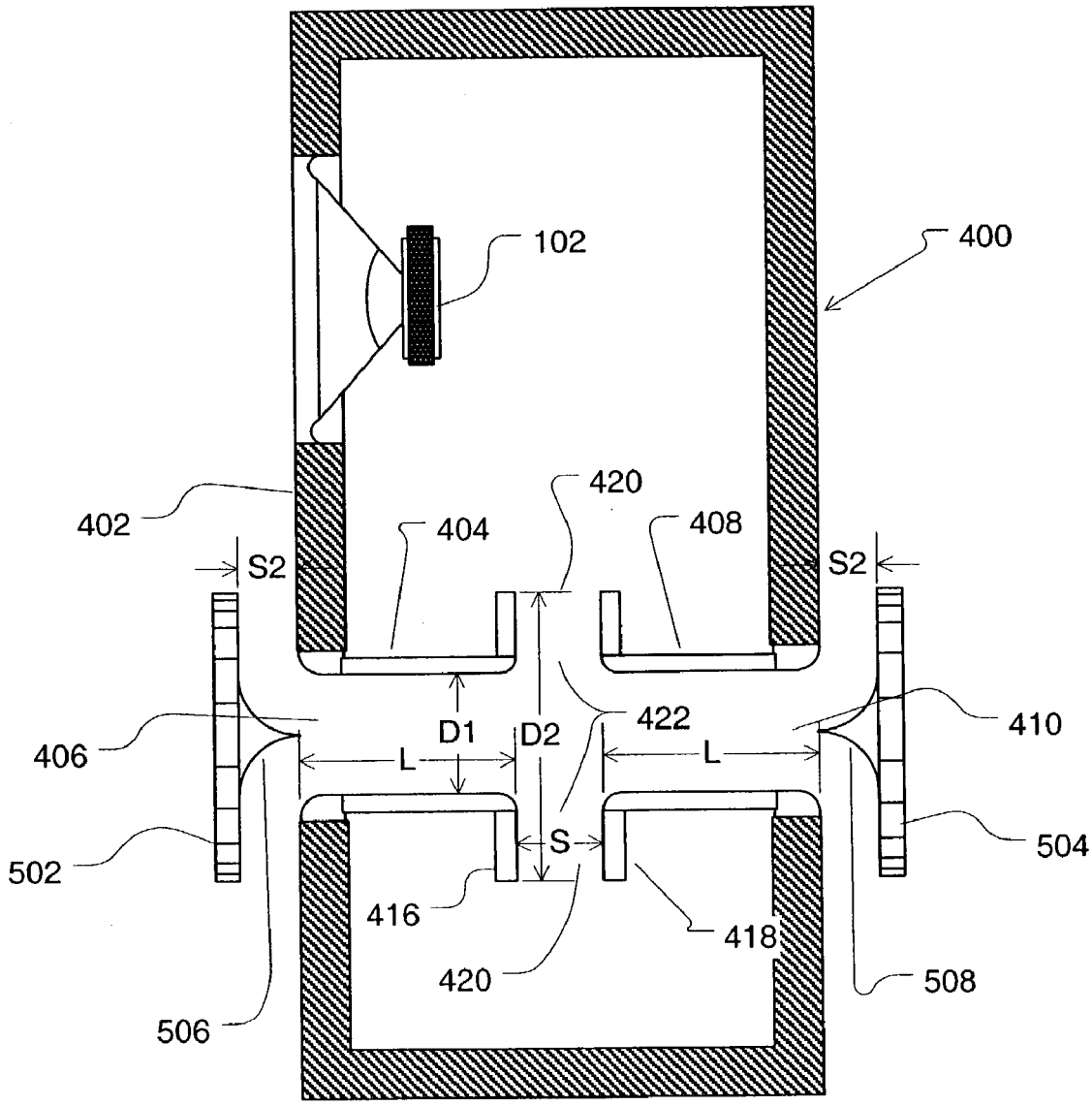

FIG. 5 is a cross-sectional view of a vented loudspeaker having a port geometry in accordance with the principles of the present invention, including discs at the outer openings of the port tubes.

Figure 6:
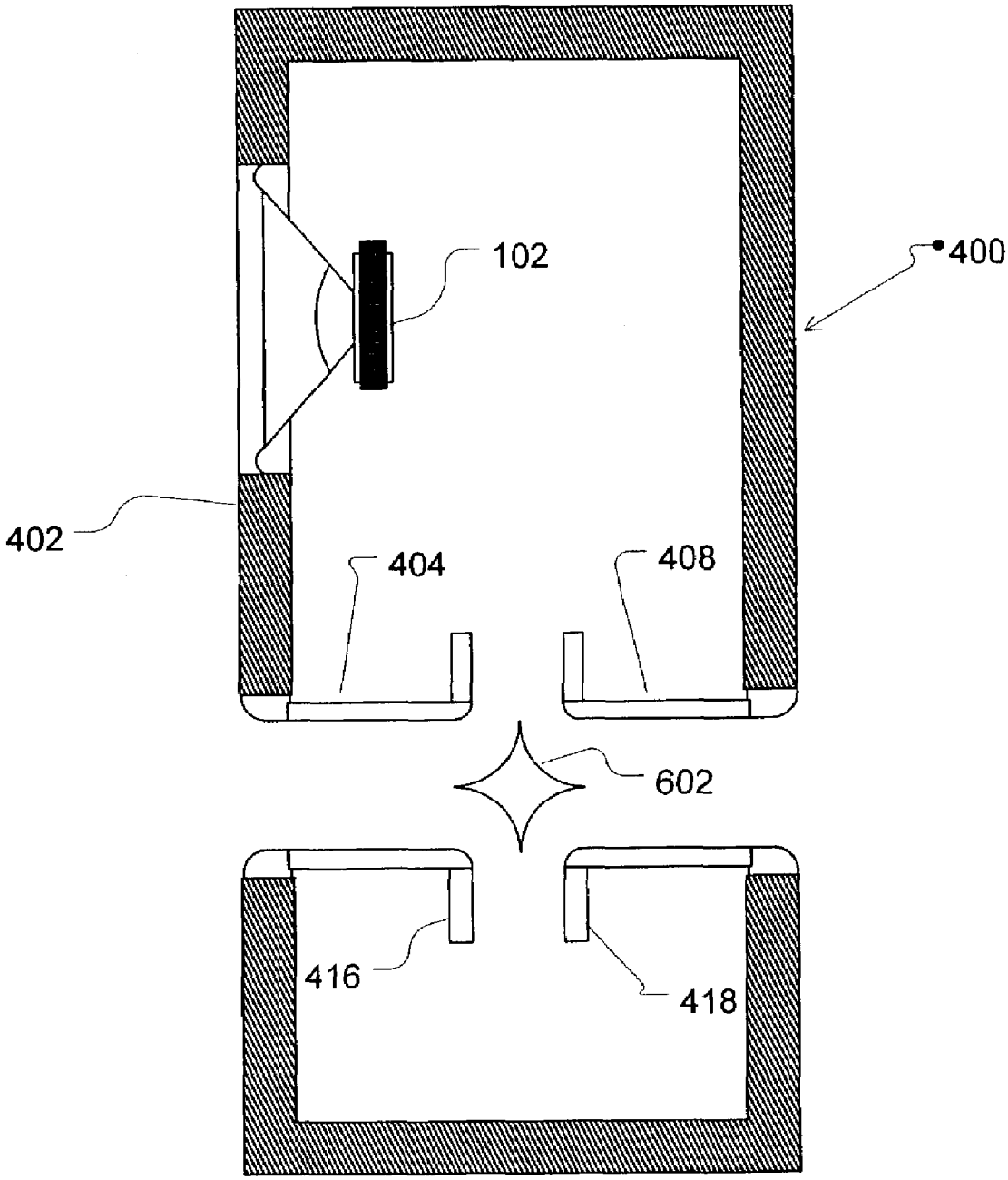

FIG. 6 is a cross-sectional view of a vented loudspeaker having a port geometry in accordance with the principles of the present invention and including a flow guide therein.

DETAILED DESCRIPTION OF THE INVENTION

Figure 1:
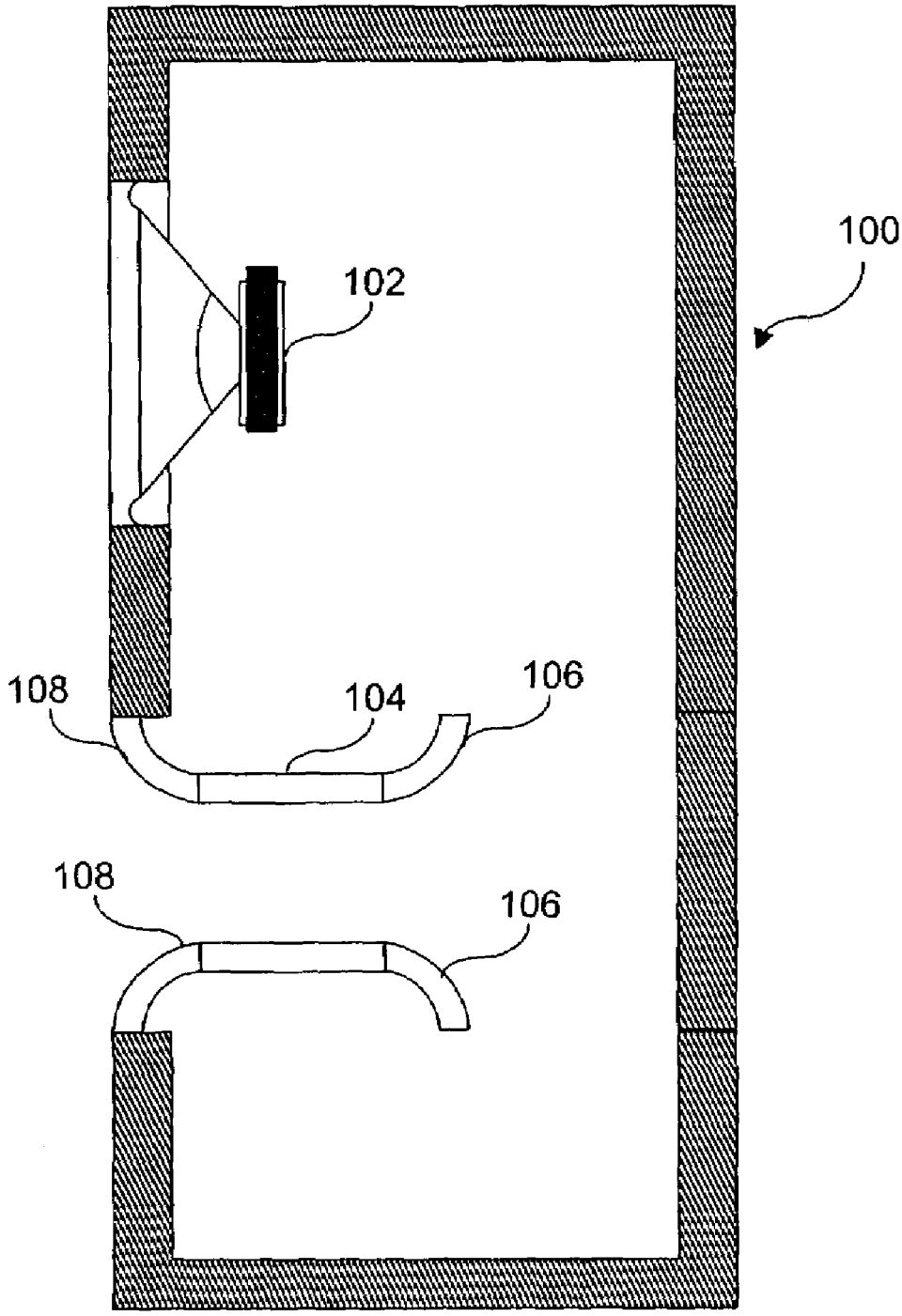
FIG. 1 is cross-sectional view of a vented loudspeaker having a flared port.

As discussed above, there are various tradeoffs involved in the design of ducted ports for a loudspeaker system. Increases in cross-sectional area required to reduce turbulence and loss require increases in port length to achieve the required acoustic mass. The increased port length may be too large for the system dimensions and may also lead to organ pipe resonances at frequencies more likely to cause audible problems. Use of flared ends as part of the port structure, as shown in FIG. 1, may reduce turbulence and loss for a given cross-sectional area in the central part of the port, but the flared ends themselves contribute little to the required acoustic mass while making the port structure substantially larger. As noted above, U.S. Pat. Nos. 5,517,573 and 5,809,154 to Polk, et al. disclose a porting method and arrangement for reducing turbulence and loss which is more compact and offers certain other advantages in suppressing unwanted midrange transmission and organ pipe resonances.

The present invention uses a novel method and arrangement to achieve additional benefits and advantages over the prior art. Referring to FIG. 4, a loudspeaker system is shown composed of an enclosure or cabinet 400 with at least one transducer 102 mounted on a speaker baffle 402. A first port tube 404 of inside diameter D1 and length L is provided on speaker baffle 402 with an outer opening 406, and a second port tube 408 of inside diameter D1 and length L, with outer opening 410, is provided on a rear wall 412 of enclosure 400 opposite speaker baffle 402 such that the two ports are on a common axis 414 and appear to provide an unobstructed open duct passing entirely through the loudspeaker enclosure from front to back. The length L of each of first and second port tubes 404, 408 is selected so as to provide a predetermined separation distance S between inside ends of the two port tubes. Circular flanges 416 and 418 of an outside diameter D2 that is greater than inside diameter D1, are affixed as shown to the inside ends of port tubes 404 and 408, respectively.

Figure 2:
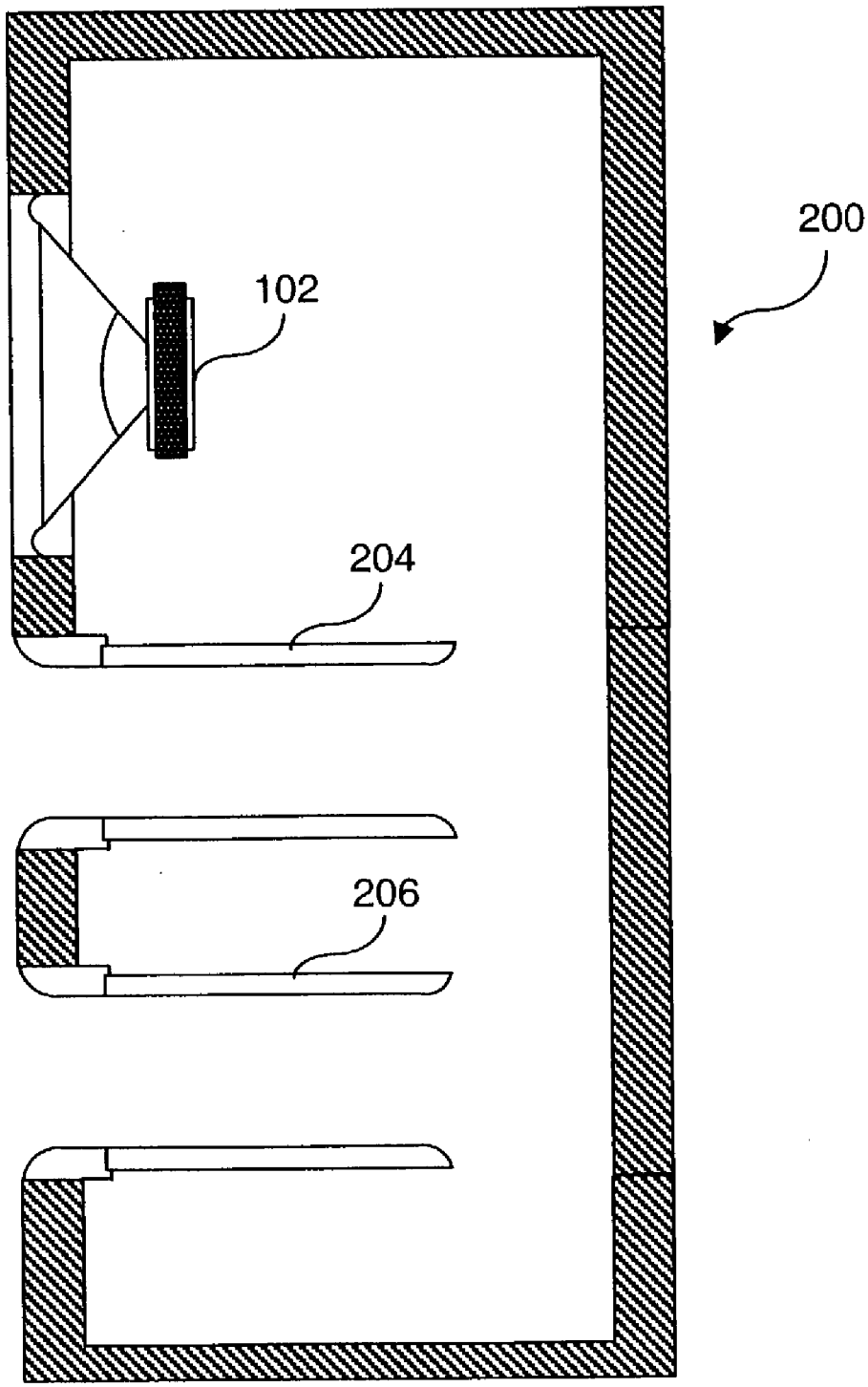
FIG. 2 is cross-sectional view of a vented loudspeaker having multiple ports.

Considered together and as a whole, the port structure shown in FIG. 4 provides a ducted path with a circumferential opening 420 between outer ends 424, 426 of flanges 416, 418, respectively, inside the loudspeaker enclosure 400, and two outside openings 406 and 410, in the speaker baffle 402 and rear wall 412, respectively. The port structure contains the air volume between the two flanges 416 and 418, and the air volume in the two port tubes 404 and 408. The entire air volume contained by the port structure is intended to function as a single acoustic mass in determining the tuning frequency of the system. In the case of substantially identical port tubes 404 and 408, the acoustic mass of the port structure is equal to approximately one half the acoustic mass of a single port plus the acoustic mass of the air space between the flanges 416 and 418, plus appropriate end corrections. For a given diameter D1 of the port tubes 404 and 408, the acoustic mass of the port structure can be conveniently adjusted by varying the separation distance S or the outer diameter D2 of the flanges 416 and 418. Increasing the flange outer diameter D2, or decreasing the separation distance S, leads to an increased total acoustic mass and a lower tuning frequency. Thus, the port structure of the present invention achieves greater acoustic mass in a more compact arrangement than using multiple conventional ports such as shown in FIG. 2.

Referring to FIG. 3, which is a reproduction of FIG. 7 of U.S. Pat. No. 5,517,573, a complete woofer system incorporating a preferred embodiment of the '573 patent is shown. In FIG. 3, an enclosure 33 is provided with a partition 34 separating the interior of the enclosure into a sealed chamber 36 and a vented chamber 37. As shown in FIG. 3, two drivers 38 and 39 are mounted in the partition 34. A port opening 41 is provided to chamber 37 with a port or vent tube 42 extending from the opening 41 back into the interior of chamber 37. Disposed to either end of the port or vent tube are disks or baffle plates 43 and 44 having associated flow directors 45 and 46. Connecting the flow directors and extending through the vent tube is a connector 47. Accordingly, the method disclosed in the '573 patent utilizes disc 43 and flow director 45 to create an increasing cross-sectional area at the inside end of single port tube 42.

In contrast and referring to FIG. 4, the present invention uses a pair of flanges 416 and 418 at the ends of two opposed port tubes 404 and 408 to create an increasing cross-sectional area at the inside end of the port structure. The larger radiating area of the combined front and rear port openings 406 and 410, and the larger combined cross-sectional area of the two port tubes has advantages in further reducing turbulence and loss at the outer ends and gives this port structure a unique bipolar radiation pattern. The cross-sectional area of the space between the flanges 416 and 418 at opening 420 is equal to $\pi$*D2*S and is greater than the cross-sectional area between the flanges at the inside opening 422, which is equal to $\pi$E*D1*S. Therefore, the effect of the port structure of the present invention as shown in FIG. 4 is to provide a duct with a cross-sectional area which increases from some minimum value to a larger value at opening 420 of the port structure and functions similarly to a flared port, as shown in FIG. 1 or U.S. Pat. No. 5,809,154, to reduce turbulence and loss. Due to their shorter wavelengths, midrange and higher frequencies generated inside enclosure 400 tend to pass through the air space between flanges 416 and 418 without entering port tubes 404 and 408. Therefore, the transmission of these higher frequencies from inside enclosure 400 to outside is reduced. Organ pipe resonances typically occur at a lowest frequency whose wavelength is approximately twice the length of a tube open at both ends. In the present invention the two port tubes 404 and 408 are separated at their inside ends by a predetermined separation distance S. This separation distance substantially eliminates any resonance associated with the combined length of the two port tubes and moves the lowest organ pipe resonance upward more than one octave to a frequency whose wavelength is approximately double the length L of one port tube 404 or 408. This higher frequency resonance is less likely to be audible and, due to the same mechanism which suppresses transmission of unwanted midrange, is less strongly excited by acoustic energy inside enclosure 400. The port structure of FIG. 4 also offers a novel cosmetic appearance in the illusion of an unobstructed open duct passing entirely through the loudspeaker enclosure.

In a first preferred embodiment of the present invention, the system Thiele-Small parameters are approximately as follows:

BL=12.6 weber/meter
Cms=0.000487 meter/newton
Sd=0.0368 sq. meters
Re=3.6 ohms
Mmd=0.1065 kg
Qms=5.5
fs=37.6 Hz
fc=45.6 Hz (the resonant frequency of the transducers when mounted in the enclosure)
V=60.5 liter (the enclosure volume)
fp=45.6 Hz (the tuning frequency of the port)

where BL is the driver motor force factor; Cms is the compliance of driver suspension; Sd is the driver cone area; Re is the driver voice coil DC resistance; Mmd is the moving mass of the driver; Qms is the mechanical Q of the driver; fs is the free-air resonance of driver; fc is the resonant frequency of the transducers when mounted in the enclosure; V is the enclosure volume; and fp is the tuning frequency of the port.

Referring to FIG. 4, an example of the port structure dimensions for this first preferred embodiment may be:

D1=4 inches
D2=6.5 inches
S=2 inches
L=6 inches

Experiments have shown that a system constructed in accordance with this first preferred embodiment of the present invention has significantly less vent noise and greater low frequency output than a similar system utilizing the conventional methods disclosed in U.S. Pat. Nos. 5,517,573 and 5,809,154.

Many variations are possible utilizing the basic principles of the present invention. For example, a flare 106 such as shown in FIG. 1 may be added to one or both of the outer ends of port tubes 404 and 408 of FIG. 4 to further decrease turbulence and loss. In a further example, and referring to FIG. 5, discs 502 and 504 may be added at one or both of the outer openings 406 and 410 of port tubes 404 and 408, respectively, at a predetermined distance S2, according to the teachings of U.S. Pat. No. 5,809,154 to provide an increasing cross-sectional area at the outer ends of the port structure for reduced turbulence and loss. Additional porting efficiency may be achieved by adding flow guides 506 and 508, according to the teachings of U.S. Pat. No. 5,517,573.

Referring to FIG. 6, further improvements in porting efficiency may be achieved by the addition of a flow guide 602 centrally located between flanges 416 and 418.

Referring again to FIG. 4, it is generally desirable that the separation distance S is selected such that the cross-sectional area of the duct where the port tubes join the inside diameter of the flanges at opening 422 and defined as $\pi$*D1*S, is approximately equal to the combined cross-sectional area of the two port tubes 404 and 408, defined as $2*\pi*(0.5*D1)^2$. However, it may be desirable to choose a smaller or larger value for the separation distance S so as to adjust the acoustic mass of the port structure to achieve the desired tuning frequency. Experiments have shown that the porting method of the present invention is effective for values of the separation distance S significantly less than one-half diameter D1 to values of separation distance S greater than twice diameter D1. For values of the separation distance S outside this range the effectiveness of the porting method of the present invention may be reduced. However, the unique benefits of a bipolar radiation pattern, large total cross-sectional area and novel appearance are maintained regardless of the separation distance S or the diameter D2 of flanges 416 and 418 of FIG. 4, and should be understood to fall within the scope of the present invention.

It is also generally desirable for the two port tubes 404 and 408 to be substantially identical. However, practical considerations may suggest the use of port tubes with different cross-sections, different lengths and different acoustic masses. It will be understood that this implementation is also within the scope of the present invention and achieves the previously discussed benefits. Similarly, it is not necessary for the port tubes 404 and 408 to be of round or circular cross-section, or that the flanges 416 and 418 be circular or round in shape. Various cross-sectional shapes for the port tubes 404 and 408 may be employed or various shapes chosen for the flanges 416 and 418, while adhering to the basic principles of the present invention, such as rectangular, square, triangular, or other shapes. It is also not necessary for the loudspeaker enclosure to be rectangular or of any particular shape so long as the port structure is constructed in accordance with the principles of the present invention disclosed herein. By way of example and not of limitation, the loudspeaker enclosure could be of cylindrical or rounded form with a port opening on one curved surface and another port opening on an opposite curved surface. Those skilled in the art will also understand that other variations may be employed while remaining within the scope of the present invention.

What is claimed is:

1. A loudspeaker system comprising:

an enclosure including a first exterior wall, a second exterior wall disposed opposite the first exterior wall, and an interior, wherein the first and second exterior walls separate the interior of said enclosure from an exterior of the loudspeaker system;

a transducer at least partially disposed within the interior of said enclosure;

a first port extending from an opening in the first exterior wall to an end of said first port in the interior of said enclosure; and a second port extending from an opening in the second exterior wall to an end of said second port in the interior of said enclosure, wherein said transducer is at least partially disposed in an interior air space that is the same interior air space occupied by the interior ends of said first and second ports, and wherein the respective ends of said first port and said second port are separated by a predetermined distance within the interior of said enclosure, such that acoustic energy from the interior air space exits said enclosure through said first and second ports approximately simultaneously and air in said first and second ports and between the interior ends of said first and second ports operates substantially as a single acoustic mass.

2. The loudspeaker system of claim 1, further comprising:

a first flange disposed at the end of said first port in the interior of said enclosure; and a second flange disposed at the end of said second port in the interior of said enclosure.

3. The loudspeaker system of claim 2, wherein said first port and said second port have a first diameter and said first flange and said second flange have a second diameter larger than said first diameter.

4. The loudspeaker system of claim 2, wherein the predetermined distance separating the respective ends and flanges of said ports is less than approximately a diameter of said first and second ports.

5. The loudspeaker system of claim 2, wherein said first flange extends around the end of said first port in the interior of said enclosure and generally away from a central axis of said first port, and said second flange extends around the end of said second port in the interior of said enclosure and generally away from a central axis of said second port, such that a cross-sectional area between said first and second flanges is larger than a cross-sectional area of either of the first or second ports.

6. The loudspeaker system of claim 1, wherein said first port and said second port are aligned on a common axis.

7. The loudspeaker system of claim 1, wherein said first port and said second port are arranged such that there is an unobstructed view from the exterior of the loudspeaker system, through the opening in said first exterior wall through the interior of the enclosure to the opening in said second exterior wall.

8. The loudspeaker system of claim 1, further comprising a flow guide disposed in the interior of said enclosure, said flow guide being located between the ends of said first port and said second port.

9. The loudspeaker system of claim 1, wherein said first port and said second port have substantially the same length.

10. The loudspeaker system of claim 1, wherein said first port and said second port are substantially circular in cross-section.

11. The loudspeaker system of claim 1, wherein said first and second ports have a diameter, and the predetermined separation distance between said first and second ports is approximately ½ of the diameter of said first and second ports.

12. A loudspeaker system comprising:

a transducer;

an enclosure including a first exterior wall, a second exterior wall disposed opposite the first exterior wall, and an interior, wherein the first and second exterior walls separate the interior from an exterior of the loudspeaker system;

a first port extending from an opening in the first exterior wall to an end of said first port in the interior of said enclosure; and a second port extending from an opening in the second exterior wall to an end of said second port in the interior of said enclosure, wherein the respective ends of said first port and said second port are separated by a predetermined distance within the interior of said enclosure such that the total acoustic radiation pattern from the first port and the second port is approximately bipolar and air in said first and second ports and between said interior ends of said first and second ports operates substantially as a single acoustic mass.

13. The loudspeaker system of claim 12, further comprising:

a first flange disposed at the end of said first port in the interior of said enclosure; and a second flange disposed at the end of said second port in the interior of said enclosure.

14. The loudspeaker system of claim 13, wherein said first port and said second port have a first diameter and said first flange and said second flange have a second diameter larger than said first diameter.

15. The loudspeaker system of claim 13, wherein the predetermined distance separating the respective ends and flanges of said ports is less than approximately a diameter of said first and second ports.

16. The loudspeaker system of claim 13, wherein said first flange extends around the end of said first port in the interior of said enclosure and generally away from a central axis of said first port, and said second flange extends around the end of said second port in the interior of said enclosure and generally away from a central axis of said second port, such that a cross-sectional area between said first and second flanges is larger than a cross-sectional area of either of the first or second ports.

17. The loudspeaker system of claim 12, wherein said first port and said second port are aligned on a common axis.

18. The loudspeaker system of claim 12, wherein said first port and said second port are arranged such that there is an unobstructed view from the exterior of the loudspeaker system, through the opening in said first exterior wall through the interior of the enclosure to the opening in said second exterior wall.

19. The loudspeaker system of claim 12, further comprising a flow guide disposed in the interior of said enclosure, said flow guide being located between the ends of said first port and said second port.

20. The loudspeaker system of claim 12, wherein said first port and said second port have substantially the same length.

21. The loudspeaker system of claim 12, wherein said first port and said second port are substantially circular in cross-section.

22. The loudspeaker system of claim 12, wherein said first and second ports have a diameter, and the predetermined separation distance between said first and second ports is approximately ½ of the diameter of said first and second ports.

23. A loudspeaker system comprising:

a transducer;

an enclosure including a first exterior wall, a second exterior wall disposed opposite the first exterior wall, and an interior, wherein the first and second exterior walls separate the interior of the enclosure from an exterior of the loudspeaker system;

a first port extending from an opening in the first exterior wall to an end of said first port, wherein the end of said first port includes a flange located in the interior of said enclosure; and a second port extending from an opening in the second exterior wall to an end of said second port, wherein the end of said second port also includes a flange located in the interior of said enclosure and oriented to oppose the flange of the first port, wherein the respective ends and flanges of said first and second ports are separated by a predetermined distance within the interior of said enclosure, such that air in said ports and between the respective ends and flanges of said first and second ports operates as a single acoustic mass.

24. The loudspeaker system of claim 23, wherein the predetermined distance separating the respective ends and flanges of said first and second ports is less than approximately a diameter of said first and second ports.

25. The loudspeaker system of claim 24, wherein said first port and said second port have a first diameter and said first flange and said second flange have a second diameter larger than said first diameter.

26. The loudspeaker system of claim 23, wherein said first port and said second port are aligned on a common axis.

27. The loudspeaker system of claim 23, wherein said first port and said second port are arranged such that there is an unobstructed view from the exterior of the loudspeaker system, through the opening in said first exterior wall through the interior of the enclosure to the opening in said second exterior wall.

28. The loudspeaker system of claim 23, further comprising a flow guide disposed in the interior of said enclosure, said flow guide being located between the ends of said first port and said second port.

29. The loudspeaker system of claim 23, wherein said first port and said second port have substantially the same length.

30. The loudspeaker system of claim 23, wherein said first port and said second port are substantially circular in cross-section.

31. The loudspeaker system of claim 23, wherein said first flange extends around the end of said first port in the interior of said enclosure and generally away from a central axis of said first port, and said second flange extends around the end of said second port in the interior of said enclosure and generally away from a central axis of said second port, such that a cross-sectional area between said first and second flanges is larger than a cross-sectional area of either of the first or second ports.

* * * * *